US006993481B2

(12) United States Patent
Skoglund et al.

(10) Patent No.: US 6,993,481 B2
(45) Date of Patent: Jan. 31, 2006

(54) DETECTION OF SPEECH ACTIVITY USING FEATURE MODEL ADAPTATION

(75) Inventors: Jan K. Skoglund, San Francisco, CA (US); Jan T. Linden, San Francisco, CA (US)

(73) Assignee: Global IP Sound AB, Stockholm (SE)

( * ) Notice: Subject to any disclaimer, the term of this patent is extended or adjusted under 35 U.S.C. 154(b) by 574 days.

(21) Appl. No.: 10/006,984

(22) Filed: Dec. 4, 2001

(65) Prior Publication Data

US 2002/0165713 A1 Nov. 7, 2002

Related U.S. Application Data

(60) Provisional application No. 60/251,749, filed on Dec. 4, 2000.

(51) Int. Cl.

| | |
|---|---|
| ***G10L 15/20*** | (2006.01) |
| ***G10L 15/08*** | (2006.01) |
| ***G10L 15/06*** | (2006.01) |
| ***G10L 15/04*** | (2006.01) |

(52) U.S. Cl. ..... 704/233; 704/236; 704/244; 704/253

(58) Field of Classification Search ..... 704/253, 704/233, 240, 210, 244

See application file for complete search history.

(56) References Cited

U.S. PATENT DOCUMENTS

| | | | | |
|---|---|---|---|---|
| 6,044,342 | A * | 3/2000 | Sato et al. | 704/233 |
| 6,349,278 | B1 * | 2/2002 | Krasny et al. | 704/233 |
| 6,421,641 | B1 * | 7/2002 | Huang et al. | 704/250 |
| 6,453,285 | B1 * | 9/2002 | Anderson et al. | 704/210 |
| 6,490,554 | B2 * | 12/2002 | Endo et al. | 704/215 |
| 6,615,170 | B1 * | 9/2003 | Liu et al. | 704/233 |

OTHER PUBLICATIONS

Sohn et al., "A voice activity detector employing soft decision based noise spectrum adaptation" Acoustics, Speech, and Signal Processing, 1998. ICASSP '98. vol. 1, Iss., May 12-15, 1998 pp. 365-368.*

Sohn et al., "A statistical model-based voice activity detection", Signal Processing Letters, IEEE , vol.: 6, Issue: 1 , Jan. 1999, pp.: 1-3.*

Paez et al., "Minimum Mean-Squared-Error Quantization in Speech PCM and DPCM Systems", Communications, IEEE Transaction on [legacy, pre—1988], vol.: 20 , Issue: 2 , Apr. 1972 pp.: 225-230.*

Levinson, "Statistical Modeling and Classification", Web Capture of http://cslu.cse.ogi.edu/HLTsurvey/ch11node4.html available at http://www.archive.org, Sep. 8, 1999.*

* cited by examiner

*Primary Examiner*—W. R. Young
*Assistant Examiner*—Brian Albertalli
(74) *Attorney, Agent, or Firm*—Townsend and Townsend and Crew LLP

(57) ABSTRACT

According to the invention, a method for detecting speech activity for a signal is disclosed. In one step, a plurality of features is extracted from the signal. An active speech probability density function (PDF) of the plurality of features is modeled, and an inactive speech PDF of the plurality of features is modeled. The active and inactive speech PDFs are adapted to respond to changes in the signal over time. The signal is probability-based classifyied based, at least in part, on the plurality of features. Speech in the signal is distinguished based, at least in part, upon the probability-based classification.

19 Claims, 6 Drawing Sheets

DETECTION OF SPEECH ACTIVITY USING FEATURE MODEL ADAPTATION

This application claims the benefit of U.S. Provisional Patent No. 60/251,749 filed on Dec. 4, 2000.

BACKGROUND OF THE INVENTION

This invention relates in general to systems for transmission of speech and, more specifically, to detecting speech activity in a transmission.

The purpose of some speech activity detection algorithms, or VAD algorithms, for transmission systems is to detect periods of speech inactivity during a transmission. During these periods a substantially lower transmission rate can be utilized without quality reduction to obtain a lower overall transmission rate. A key issue in the detection of speech activity is to utilize speech features that show distinctive behavior between the speech activity and noise. A number of different features have been proposed in prior art.

Time Domain Measures

In a low background noise environment, the signal level difference between active and inactive speech is significant. One approach is therefore to use the short-term energy and tracking energy variations in the signal. If energy increases rapidly, that may correspond to the appearance of voice activity, however it may also correspond to a change in background noise. Thus, although that method is very simple to implement, it is not very reliable in relatively noisy environments, such as in a motor vehicle, for example. Various adaptation techniques and complementing the level indicator with another time-domain measures, e.g. the zero crossing rate and envelope slope, may improve the performance in higher noise environments.

Spectrum Measures

In many environments, the main noise sources occur in defined areas of the frequency spectrum. For example, in a moving car most of the noise is concentrated in the low frequency regions of the spectrum. Where such knowledge of the spectral position of noise is available, it is desirable to base the decision as to whether speech is present or absent upon measurements taken from that portion of the spectrum containing relatively little noise.

Numerous techniques are known that have been developed for spectral cues. Some techniques implement a Fourier transform of the audio signal to measure the spectral distance between it and an averaged noise signal that is updated in the absence of any voice activity. Other methods use sub-band analysis of the signal, which are close to the Fourier methods. The same applies to methods that make use of cepstrum analysis.

The time-domain measure of zero-crossing rate is a simple spectral cue that essentially measures the relation between high and low frequency contents in the spectrum. Techniques are also known to take advantage of periodic aspects of speech. All voiced sounds have determined periodicity—whereas noise is usually aperiodic. For this purpose, autocorrelation coefficients of the audio signal are generally computed in order to determine the second maximum of such coefficients, where the first maximum represents energy.

Some voice activity detection (VAD) algorithms are designed for specific speech coding applications and have access to speech coding parameters from those applications. An example is the G729 application, which employs four different measurements on the speech segment to be classified. The measured parameters are the zero-crossing rate, the full band speech energy, the low band speech energy, and 10 line spectral frequencies from a linear prediction analysis.

Problems with Conventional Solutions

Most VAD features are good at separating voiced speech from unvoiced speech. Therefore the classification scenario is to distinguish between three classes, namely, voiced speech, unvoiced speech, and inactivity. When the background noise becomes loud it can be difficult to distinguish between active unvoiced speech and inactive background noise. Virtually all VAD algorithms have problems with the situation where a single person is also talking over background noise that consists of other people talking (often referred to as babble noise) or an interfering talker.

Likelihood Ratio Detection

A classic detection problem is to determine whether a received entity belongs to one of two signal classes. Two hypotheses are then possible. Let the received entity be denoted r, then the hypotheses can be expressed:

$$H_1: r \in S_1$$

$$H_0: r \in S_0$$

where $S_1$ and $S_0$ are the signal classes. A Bayes decision rule, also called a likelihood ratio test, is used to form a ratio between probabilities that the hypotheses are true given the received entity r. A decision is made according to a threshold $\tau_B$:

$$L_B(r) = \frac{Pr(r \mid H_1)}{Pr(r \mid H_0)} \begin{cases} \geq \tau_B & \text{choose } H_1 \\ < \tau_B & \text{choose } H_0 \end{cases}$$

The threshold $\tau_B$ is determined by the a priori probabilities of the hypotheses and costs for the four classification outcomes. If we have uniform costs and equal prior probabilities then $\tau_B=1$ and the detection is called a maximum likelihood detection. A common variant used for numerical convenience is to use logarithms of the probabilities. If the probability density functions for the hypotheses are known, the log likelihood ratio test becomes:

$$L(r) = \log\left(\frac{Pr(r \mid H_1)}{Pr(r \mid H_0)}\right) = \log\left(\frac{f_{H_1}(r)}{f_{H_0}(r)}\right) \begin{cases} \geq \tau & \text{choose } H_1 \\ < \tau & \text{choose } H_0 \end{cases}$$

Gaussian Mixture Modeling

Likelihood ratio detection is based on knowledge of parameter distributions. The density functions are mostly unknown for real world signals, but can be assumed to be of a simple, e.g. Gaussian, distribution. More complex distributions can be estimated with more general probability density function (PDF) models. In speech processing, Gaussian mixture (GM) models have been successfully employed in speech recognition and in speaker identification.

A Gaussian mixture PDF for d-dimensional random vectors, x, is a weighted sum of densities:

$$f_x(x) = \sum_{k=1}^{M} \rho_k f_{\mu_k, \Sigma_k}(x)$$

where $\rho_k$ are the component weights, and the component densities to $f_{\mu_k,\Sigma_k}(x)$ are Gaussian with mean vectors $\mu_k$ and covariance matrices $\Sigma_k$. The component weights are constrained by $$\rho_k > 0 \text{ and } \sum_{k=1}^{M} \rho_k = 1.$$

Adaptive Algorithms

The GM parameters are often estimated using an iterative algorithm known as an expectation-maximum (EM) algorithm. In classification applications, such as speaker recognition, fixed PDF models are often estimated by applying the EM algorithm on a large set of training data offline. The results are then used as fixed classifiers in the application. This approach can be used successfully if the application conditions (recording equipment, background noise, etc) are similar to the training conditions. In an environment where the conditions change over time, however, a better approach utilizes adaptive techniques. A common adaptive strategy in signal processing is called gradient methods where parameters are updated so that a distortion criterion is decreased. This is achieved by adding small values to the parameters in the negative direction of the first derivative of the distortion criterion with respect to the parameters.

BRIEF DESCRIPTION OF THE DRAWINGS

The present invention is described in conjunction with the appended figures.

In the appended figures, similar components and/or features may have the same reference label.

DETAILED DESCRIPTION OF THE PREFERRED EMBODIMENT

The ensuing description provides preferred exemplary embodiment(s) only, and is not intended to limit the scope, applicability or configuration of the invention. Rather, the ensuing description of the preferred exemplary embodiment (s) will provide those skilled in the art with an enabling description for implementing a preferred exemplary embodiment of the invention. It being understood that various changes may be made in the function and arrangement of elements without departing from the spirit and scope of the invention as set forth in the appended claims.

An ideal speech detector is highly sensitive to the presence of speech signals while at the same time remaining insensitive to non-speech signals, which typically include various types of environmental background noise. The difficulty arises in quickly and accurately distinguishing between speech and certain types of noise signals. As a result, voice activity detection (VAD) implementations have to deal with the trade-off situation between speech clipping, which is speech misinterpreted as inactivity, on one hand and excessive system activity due to noise sensitivity on the other hand.

Standard procedures for VAD try to estimate one or more feature tracks, e.g. the speech power level or periodicity. This gives only a one-dimensional parameter for each feature and this is then used for a threshold decision. Instead of estimating only the current feature itself, the present invention dynamically estimates and adapts the probability density function (PDF) of the feature. By this approach more information is gathered, in terms of degrees of freedom for each feature, to base the final VAD decision upon.

In one embodiment, the classification is based on statistical modeling of the speech features and likelihood ratio detection. A feature is derived from any tangible characteristic of a digitally sampled signal such as the total power, power in a spectral band, etc. The second part of this embodiment is the continuous adaptation of models, which is used to obtain robust detection in varying background environments.

The present invention provides a speech activity detection method intended for use in the transmitting part of a speech transmission system. One embodiment of the invention includes four steps. The first step of the method consists of a speech feature extraction. The second step of the method consists of log-likelihood ratio tests, based on an estimated statistical model, to obtain an activity decision. The third step of the method consists of a smoothing of the activity decision for hangover periods. The fourth step of the method consists of adaptation of the statistical models.

Figure 1:
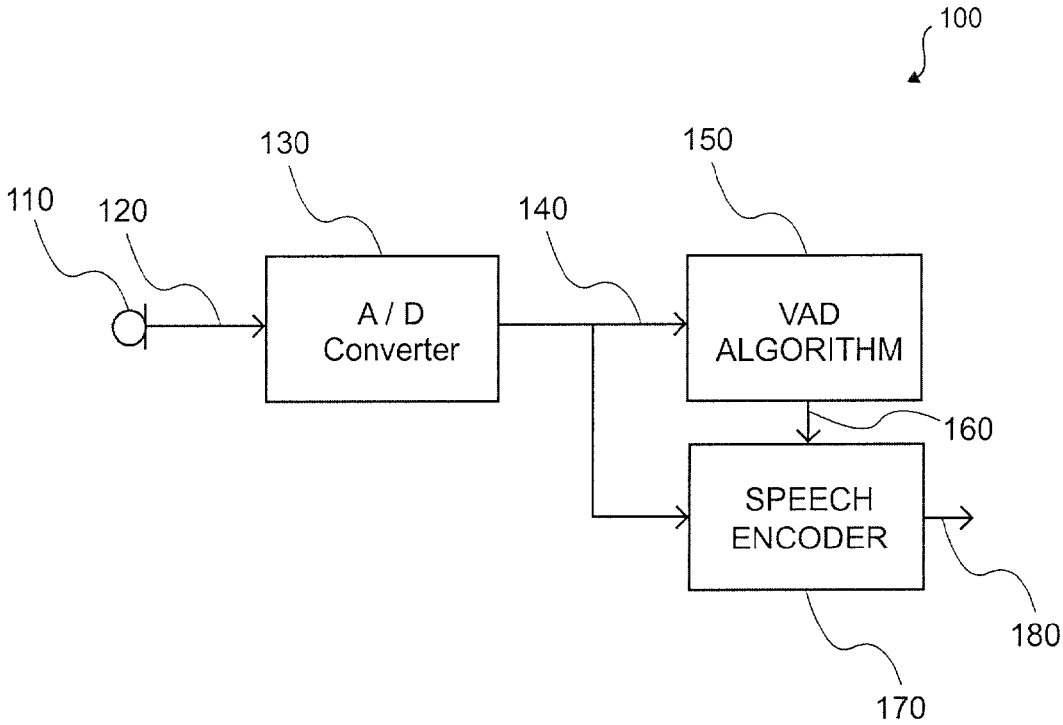
FIG. 1 presents an overview block diagram of an embodiment of a transmitting part of a speech transmitter system.

Referring first to FIG. 1, a block diagram for the transmitting part of a speech transmitter system 100 is shown. The sound is picked up by a microphone 110 to produce an electric signal 120, which is sampled and quantized into digital format by an A/D converter 130. The sample rate of the sound signal is chosen to be adequate for the bandwidth of the signal and can typically be 8 KHz, or 16 KHz for speech signals and 32 KHz, 44.1 KHz or 48 KHz for other audio signals such as music, but other sample rates may be used in other embodiments. The sampled signal 140 is input to a VAD algorithm 150. The output 160 of the VAD algorithm 150 and the sampled signal 140 is input to the speech encoder 170. The speech encoder 170 produces a stream of bits 180 that are transmitted over a digital channel.

VAD Procedure

The VAD approach taken by the VAD algorithm 150 in this embodiment is based on a priori knowledge of PDFs of specific speech features in the two cases where speech is active or inactive. The observed signal, u(t), is expressed as a sum of a non-speech signal, n(t), and a speech signal, s(t), which is modulated by a switching function, θ(t):

$$u(t)=\theta(t)s(t)+n(t)\theta(t)\epsilon\{0,1\}$$

The signals contain feature parameters, $x_s$ and $x_n$, and the observed signal can be written as:

$$u(t,x(t))=\theta(t)s(t,x_s(t))+n(t,x_n(t))$$

It is assumed that the feature parameters can be extracted from the observed signal by some extraction procedure. For every time instant, t, the probability density function for the feature can be expressed as:

$$f_x(x)=f_{x|\theta=0}(x|\theta=0)Pr(\theta=0)+f_{x|\theta=1}(x|\theta=1)Pr(\theta=1)$$

With access to the speech and non-speech conditional PDFs, we can regard the problem as a likelihood ratio detection problem:

$$L(x_0) = \log\left(\frac{f_{x|\theta=1}(x_0)}{f_{x|\theta=0}(x_0)}\right)\begin{cases} \geq \tau & \text{choose } H_1 \\ < \tau & \text{choose } H_0 \end{cases}$$

where $x_0$ is the observed feature and $\tau$ is the threshold. The higher the ratio, generally, the more likely the observed feature corresponds to speech being present in the sampled signal. It is possible to adjust the decision to avoid false classification of speech as inactivity by letting $\tau<0$. The threshold can also be determined by the a priori probabilities of the two classes, if these probabilities are assumed to be known. The PDFs for speech and non-speech are estimated offline in a training phase for this embodiment.

Figure 2A:
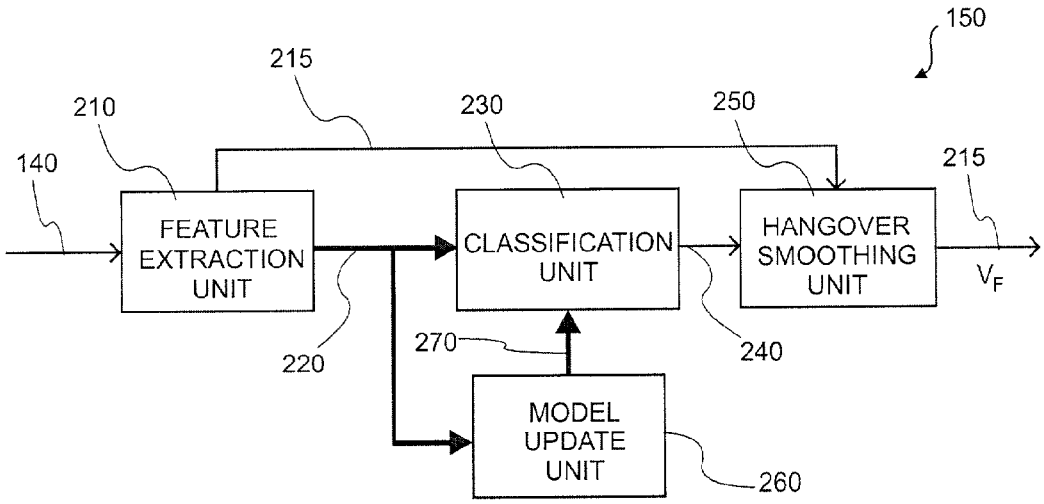
FIG. 2A presents an overview block diagram of a first embodiment of a VAD algorithm system.
Figure 2B:
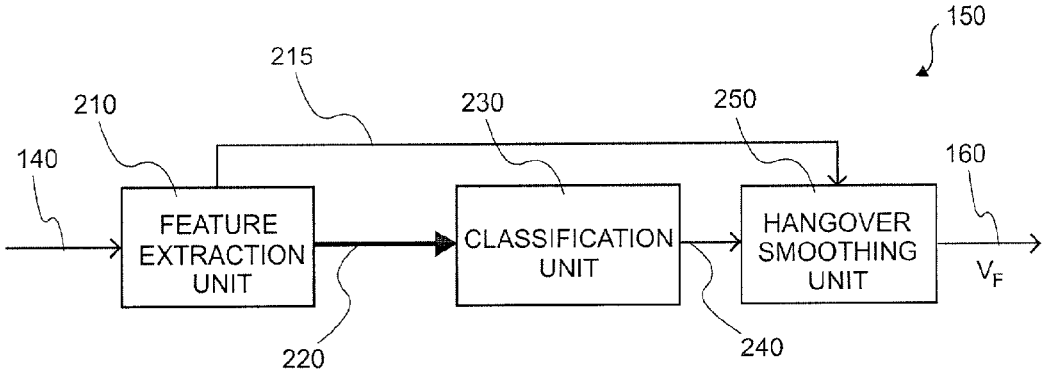
FIG. 2B presents an overview block diagram of a second embodiment of a VAD algorithm system.

With reference to FIGS. 2A and 2B, embodiments of VAD algorithm systems 150 are shown. The embodiment of FIG. 2A includes a model update unit 260 to adapt the models to various signal conditions over time to increase likelihood. In contrast, the embodiment of FIG. 2B does not adapt over time. The VAD algorithm system 150 consists of four major parts, namely, a feature extraction unit 210, classification unit 230, a hangover smoothing function 250, and a model update function 260. The VAD algorithm function 150 generally operates according to the following four steps. First, a set of speech features are extracted by the feature extraction unit 210. Second, features 220 produced by the feature extraction function 210 are used as arguments in the first classification 230. Third, an initial decision 240 that is produced from the classification unit 230 is smoothened by the hangover smoothing function 250. Fourth, the statistical models in the model update function 260 are updated based on the current features such that the models are iteratively improved over time. Below each of these four steps are described in further detail.

Feature Extraction

Figure 3:
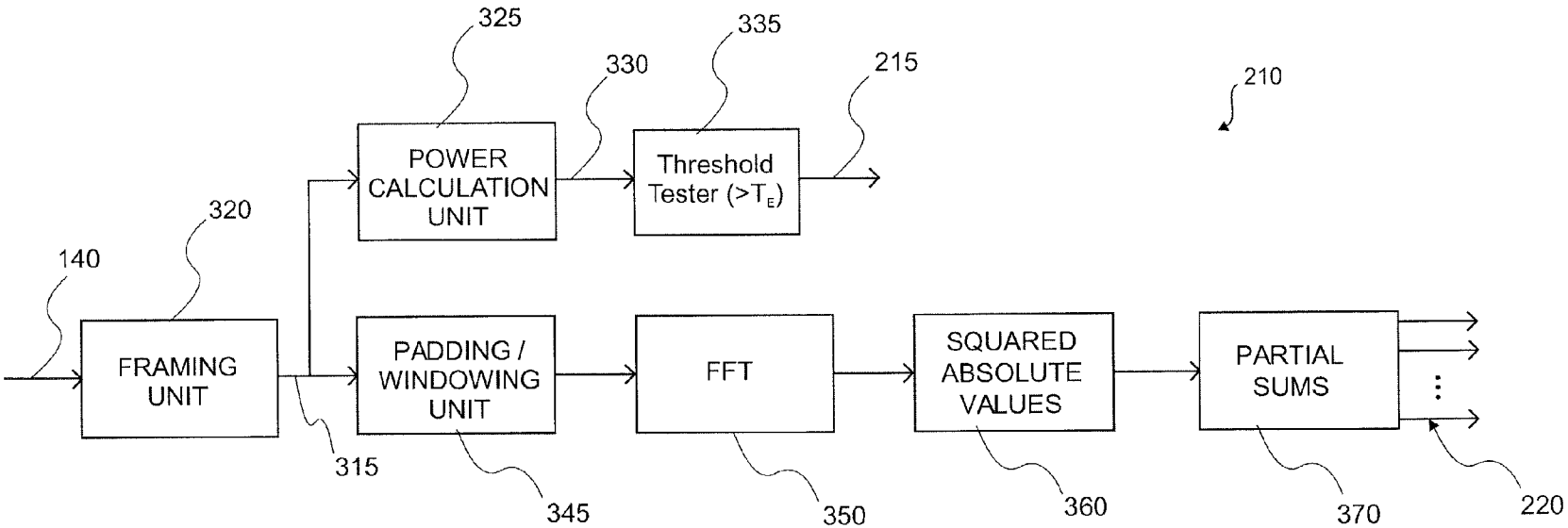
FIG. 3 presents an overview block diagram of an embodiment of a feature extraction unit.

An embodiment of the feature extraction unit 210 is depicted in FIG. 3. The sampled speech signal 140 is divided into frames 315 of $N_{fr}$ samples by the framing unit 320. If the frame power 330, as determined by a power calculation unit 325, is below a certain threshold, $T_E$, a binary decision variable 215, $V_P$, is set to zero by a threshold tester 315 for later use in the classification. In this embodiment, an $N_{ft}$ ($N_{ft}>N_{fr}$) samples-long discrete fast Fourier transform (FFT) 350 operates upon a zero-padded and windowed frame produced by the padding and windowing unit 345. The signal powers in N bands, $x_j$, (the "N powers") 220 are calculated by adding the logarithms of the absolute values of the Fourier coefficients in each band and normalizing them with the length of the band with the squared absolute values 15 block 220 and the partial sums block 370. These N powers 220 are the features used in the classification.

Likelihood Ratio Tests

Figure 4A:
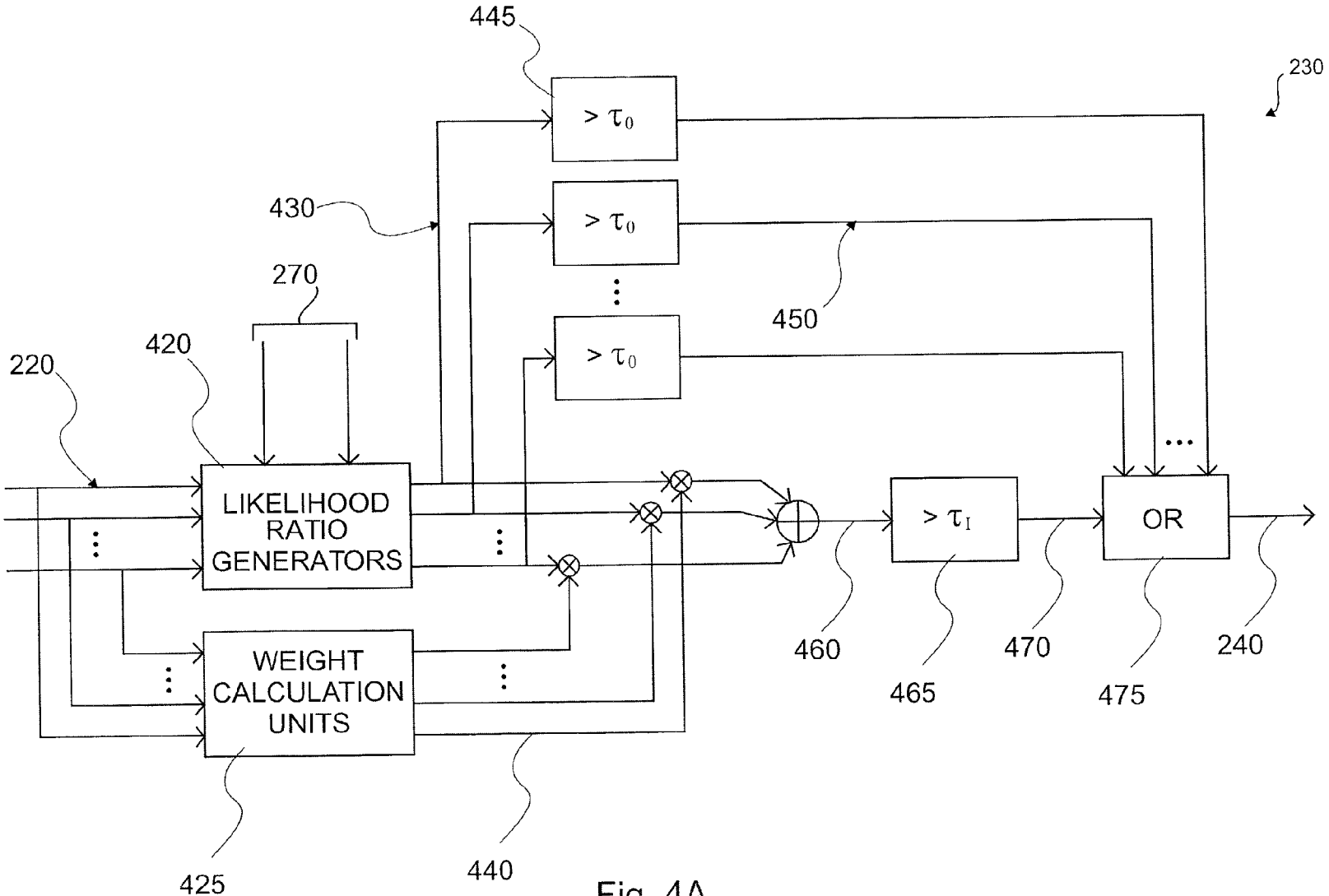
FIG. 4A presents an overview block diagram of the first embodiment of a classification unit.
Figure 4B:
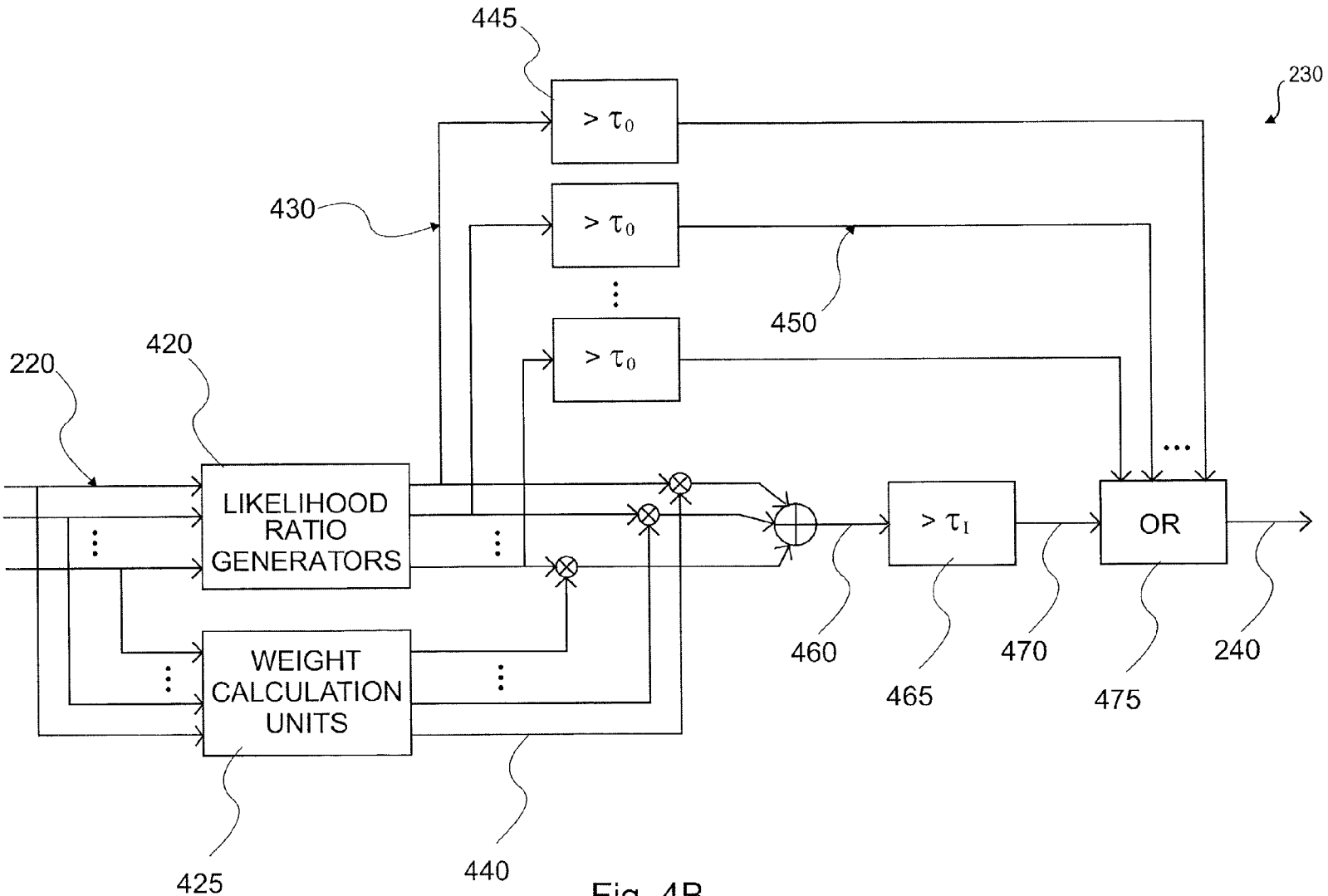
FIG. 4B presents an overview block diagram of the second embodiment of a classification unit.

Two embodiments of the classification unit 230 are shown in FIGS. 4A and 4B. The embodiment of FIG. 4A interfaces with the embodiment of the VAD algorithm system 150 of FIG. 2A and includes adaptive inputs 270. The embodiment of FIG. 4B interfaces with the embodiment of the VAD algorithm system 150 of FIG. 2B and does not have an adaptive feature. In these embodiments, the N powers 220 or N features 220, $x_j$, are used in $N_C$ parallel $N_m$-dimensional likelihood ratio generators 420, where $$N = \sum_{m=1}^{N_C} N_m.$$

A likelihood ratio 430, $\eta_m$, is calculated with the likelihood ratio generators 420 by taking the logarithm of a ratio between the activity PDF value and the inactivity PDF value obtained by using the feature as arguments to the PDFs:

$$\eta_m = \log\left(\frac{f_m^{(S)}(x_m)}{f_m^{(N)}(x_m)}\right) \quad m = 1 \ldots N_C$$

where $f_m^{(S)}$ denotes the activity PDF, $f_m^{(N)}$ denotes the inactivity PDF, and $x_m$ are $N_m$-dimensional vectors formed by grouping the features $x_j$. A weight calculation unit 425 determines a weighting factor 440, $v_m$, for each likelihood ratio 430. A test variable 460, y, is then calculated as a weighted sum of the ratios:

$$y = \sum_{m=1}^{N_C} \eta_m v_m$$

Experimentation may be used to determine the best weighting for each likelihood ratio 430. In one embodiment, each likelihood ratio 430 is equally weighted.

The test variable 460 is compared to a certain threshold, $\tau_I$, by a first decision block 465 to obtain a decision variable 470, $V_L$,:

$$y\begin{cases} \geq \tau_I & V_L = 1 \\ < \tau_I & V_L = 0 \end{cases}$$

If an individual channel indicates strong activity by having a large likelihood ratio 430, $\eta_m$, greater than another threshold, $\tau_0$, then a corresponding variable 450, $V_m$, is set to equal one in a second decision block 445. The initial activity classification 240, $V_I$, is calculated as the logical OR of the corresponding and decision variables 450, 470.

This embodiment of the invention utilizes Gaussian mixture models for the PDF models, but the invention is not to be so limited. In the following description of this embodiment, $N_m$=1 and $N_C$=N will be used to imply one-dimensional Gaussian mixture models. It is entirely in the spirit of the invention to employ a number of multivariate Gaussian mixture models.

Hangover Smoothing

Figure 5:
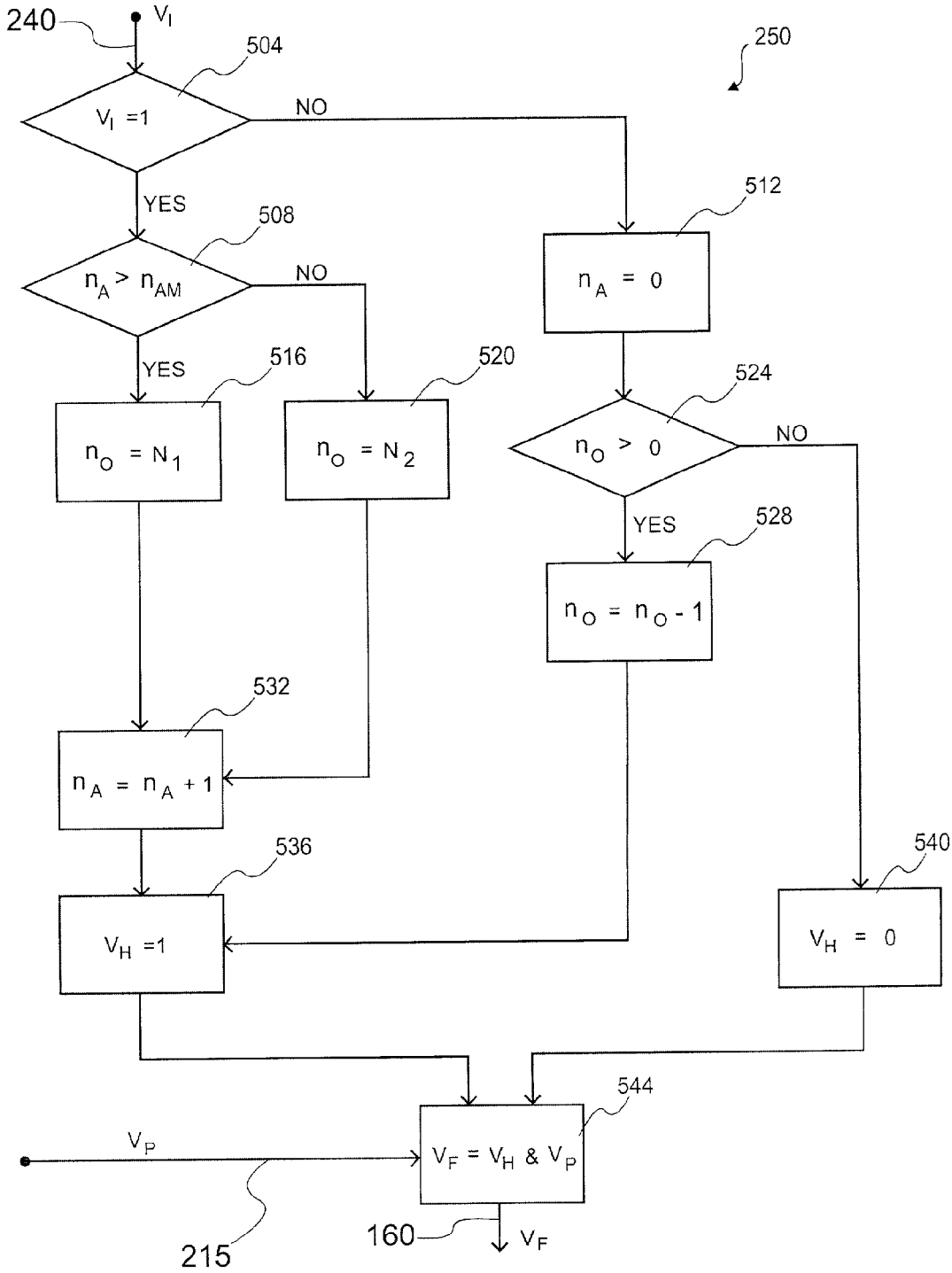
FIG. 5 presents a flow diagram of an embodiment of a hangover algorithm.

With reference to FIG. 5, an embodiment of a hangover algorithm 250 is used to prevent clipping in the end of a talk spurt. The hangover time is dependent of the duration of the current activity. If the talk spurt, $n_A$, is longer than $n_{AM}$ frames, the hangover time, $n_O$, is fixed to $N_1$ frames, otherwise a lower fixed hangover time of $N_2$ frames is used as shown in steps 508, 516 and 520. A logical AND between the output of the hangover smoothing, $V_H$, and the frame power binary variable 215, $V_P$, yields the final VAD decision 160, $V_F$. If $V_I$=1 then $V_H$=1 in step 536 and a counter, $n_A$, is incremented in step 532 to count the number of consecutive active frames. Otherwise, if $V_I$, became 0 within the last $N_1$ or $N_2$ frames then $V_H$=1 shown in steps 512, 524 and 528. If $V_I$, has been 0 longer than $N_1$ or $N_2$ frames, then $V_H$=0 in steps 512, 524 and 540.

Model Update

Figure 6:
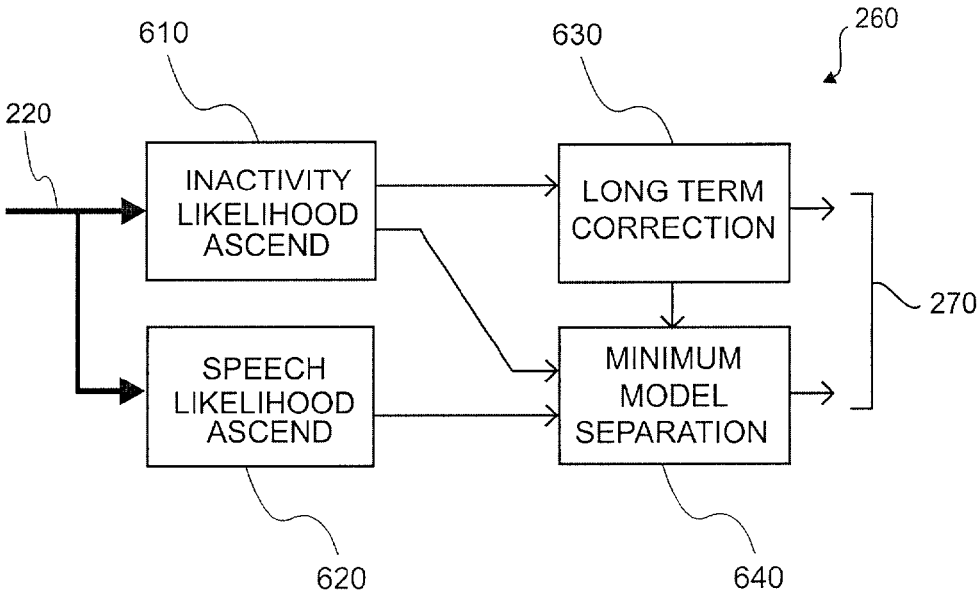
FIG. 6 presents an overview block diagram of an embodiment of a model update unit.

The parameters of the active and the inactive PDF models are updated after every frame in the adaptive embodiment shown in FIG. 2A. Feature data is sampled over time by the model update unit 260 to affect operation in the classification unit 230 to increase likelihood. The stages of updates are performed by the model update unit 260 depicted in FIG. 6. Both the PDF models are first updated by a gradient method for a likelihood ascend adaptation using an inactivity likelihood ascend unit 610 and a speech likelihood ascend unit 620. The inactive PDF model parameters are then adapted to reflect the background by a long-term correction 630. Finally, a test is performed to assure a minimum model separation 640, where the active PDF model parameters may be further adapted.

Likelihood Ascend

The PDF parameters are updated to increase the likelihood. The parameters are the logarithms of the component weights, $\alpha_{j,k}^{(N)}$ and $\alpha_{j,k}^{(S)}$, the component means, $\mu_{j,k}^{(N)}$ and $\mu_{j,k}^{(S)}$, and the variances, $\lambda_{j,k}^{(N)}$ and $\lambda_{j,k}^{(S)}$. For notation convenience the symbol a+=b will in the following denote a(n+1)=a(n)+b(n), where n is an iteration counter. For the update equations we calculate the following probabilities $$H_{0,j} = f_j^{(N)}(x_j(n)) = \sum_{k=1}^{M} \rho_{j,k}^{(N)} f_{j,k}^{(N)}(x_j(n)) \quad H_{1,j} = f_j^{(S)}(x_j(n)) = \sum_{k=1}^{M} \rho_{j,k}^{(S)} f_{j,k}^{(S)}(x_j(n))$$

$$p_{j,k}^{(N)} = \frac{\rho_{j,k}^{(N)} f_{j,k}^{(N)}(x_j(n))}{H_{0,j}} \qquad p_{j,k}^{(S)} = \frac{\rho_{j,k}^{(S)} f_{j,k}^{(S)}(x_j(n))}{H_{1,j}}$$

The logarithms of the component weights are updated according to $$\alpha_{j,k}^{(N)} += v_\alpha p_{j,k}^{(N)} \quad \alpha_{j,k}^{(S)} += v_\alpha p_{j,k}^{(S)}$$

$$\rho_{j,k}^{(N)} = \exp\alpha_{j,k}^{(N)} \quad \rho_{j,k}^{(S)} = \exp\alpha_{j,k}^{(S)}$$

where $V_\alpha$ is some constant controlling the adaptation. The component weights are restricted not to fall below a minimum weight $\rho_{min}$. They must also add to one and this is assured by $$\rho_{j,k}^{(N)} = \frac{\rho_{j,k}^{(N)}}{\sum_{i=1}^{M} \rho_{i,k}^{(N)}} \quad \rho_{j,k}^{(S)} = \frac{\rho_{j,k}^{(S)}}{\sum_{i=1}^{M} \rho_{i,k}^{(S)}}$$

$$\alpha_{j,k}^{(N)} = \ln\rho_{j,k}^{(N)} \quad \alpha_{j,k}^{(S)} = \ln\rho_{j,k}^{(S)}$$

The variance parameters are updated as standard deviations $$\sigma_{j,k}^{(N)} += v_\sigma p_{j,k}^{(N)} \frac{\left(\frac{(x_j(n)-\mu_{j,k}^{(N)})^2}{\lambda_{j,k}^{(N)}} - 1\right)}{\sigma_{j,k}^{(N)}} \quad \sigma_{j,k}^{(S)} += v_\sigma p_{j,k}^{(S)} \frac{\left(\frac{(x_j(n)-\mu_{j,k}^{(S)})^2}{\lambda_{j,k}^{(S)}} - 1\right)}{\sigma_{j,k}^{(S)}}$$

$$\lambda_{j,k}^{(N)} = (\sigma_{j,k}^{(N)})^2 \qquad \lambda_{j,k}^{(S)} = (\sigma_{j,k}^{(S)})^2$$

The variance parameters, $\lambda_{j,k}$, are restricted not to fall below a minimum value of $\lambda_{min}$.

The component means are updated similarly $$\mu_{j,k}^{(N)} += v_\mu p_{j,k}^{(N)} \left(\frac{x_j(n)-\mu_{j,k}^{(N)}}{\lambda_{j,k}^{(N)}}\right) \quad \mu_{j,k}^{(S)} += v_\mu p_{j,k}^{(S)} \left(\frac{x_j(n)-\mu_{j,k}^{(S)}}{\lambda_{j,k}^{(S)}}\right)$$

As with the component weights, the update equations for the means and the standard deviations also contain adaptation constants, $v_\mu$ and $v_\sigma$, controlling the step sizes.

Long Term Correction

In a sufficiently long window there is most likely some inactive frames. The frame with the least power in this window is likely a non-speech frame. To obtain an estimate of the average background level in each band we take the average of the least $N_{sel}$ power values of the latest $N_{back}$ frames:

$$b_j = 0.99 \cdot \frac{1}{N_{sel}} \sum_{i=1}^{N_{sel}} x_j^{(i)}$$

where $x_j^{(i)} < x_j^{(i+1)}$ are the sorted past feature (power) values $\{x_j(n), x_j(n-1), \ldots, x_j(n-N_{back})\}$. The mixture component means of the non-speech PDF are then adapted towards this value according to the equation:

$$\mu_{j,k}^{(N)} += \varepsilon_{back}(b_j - m_j^{(N)})$$

where the GMM "global" mean is given by $$m_j^{(N)} = \sum_{k=1}^{M} \rho_{j,k}^{(N)} \mu_{j,k}^{(N)}$$

and the adaptation is controlled by the factor $\epsilon_{back}$.

Minimum Model Separation

In order to keep the speech and non-speech PDFs well separated the mixture component means of the active PDF are then adjusted according to the equations:

$$\Delta_j^{(m)} = m_j^{(S)} - m_j^{(N)}$$

$$\Delta_j^{(m)} < \Delta_j^{(\min)} \Rightarrow \mu_{j,k}^{(S)} += \left(\Delta_j^{(\min)} - \Delta_j^{(m)}\right) \cdot 0.95$$

$$\text{where } m_j^{(N)} = \sum_{k=1}^{M} \rho_{j,k}^{(N)} \mu_{j,k}^{(N)},$$

$$m_j^{(S)} = \sum_{k=1}^{M} \rho_{j,k}^{(S)} \mu_{j,k}^{(S)}, \text{ and } \Delta_j^{(\min)} \text{ a pre-defined}$$

minimum distance. In one embodiment, an additional 5% separation is provided by applying the above technique.

While the principles of the invention have been described above in connection with specific apparatuses and methods, it is to be clearly understood that this description is made only by way of example and not as limitation on the scope of the invention.

What is claimed is:

1. A method for detecting speech activity for a signal, the method comprising the steps of:

extracting a plurality of features from a digitized signal, wherein:

the plurality of features alone cannot recreate the digitized signal, and the digitized signal is a digital representation of the signal;

modeling a first and a second probability density functions (PDFs) of the plurality of features, wherein:

the first PDF models active speech features for the digitized signal, the second PDF models inactive speech features for the digitized signal, and at least one of the first or second PDFs uses a non-Gaussian model;

adapting the first and second PDFs to respond to changes in the digitized signal over time;

probability-based classifying of the digitized signal based, at least in part, on the plurality of features; and distinguishing speech in the digitized signal based, at least in part, upon the probability-based classifying step.

2. The method for detecting speech activity for the signal as recited in claim 1, wherein the probability-based classifying step uses the first and second PDFs.

3. The method for detecting speech activity for the signal as recited in claim 1, wherein the modeling step comprises a step of determining a mathematical model for the digitized signal from the plurality of features.

4. The method for detecting speech activity for the signal as recited in claim 1, wherein the adapting step comprises a step of increasing a likelihood.

5. The method for detecting speech activity for the signal as recited in claim 1, wherein the adapting step comprises a step of identifying extreme values in a plurality of previous frames.

6. The method for detecting speech activity for the signal asrecited in claim 1, wherein the probability-based classifying step comprises a step of classifying based on likelihood ratio detection.

7. The method for detecting speech activity for the signal as recited in claim 1, wherein the probability-based classifying step comprises applying a log-likelihood ratio test to one of the plurality of features.

8. The method for detecting speech activity for the signal as recited in claim 1, wherein at least one of the first or second PDFs comprises a Gaussian mixture model.

9. The method for detecting speech activity for the signal as recited in claim 1, wherein at least one of the first or second PDFs comprises a plurality of basic density models.

10. The method for detecting speech activity for the signal as recited in claim 1, wherein at least one of the plurality of features is related to power in a spectral band of the digitized signal.

11. The method for detecting speech activity for the signal as recited in claim 1, further comprising a step of smoothing an activity decision for hangover periods to produce a smoothed activity decision.

12. A computer-readable medium having computer-executable instructions for performing the computer-implementable method for detecting speech activity for the signal of claim 1.

13. A method for detecting sound activity for a signal, the method comprising the steps of:

extracting a plurality of features from a digitized signal, wherein:

the plurality of features do not fully represent the digitized signal, and the digitized signal is a digital representation of the signal;

modeling an active sound probability density function (PDF) of the plurality of features;

modeling an inactive sound PDF of the plurality of features;

adapting the active and inactive sound PDFs to respond to changes in the digitized signal over time;

probability-based classifying of the digitized signal based, at least in part, on the plurality of features; and distinguishing sound in the digitized signal based, at least in part, upon the probability-based classifying step, wherein at least one of the active or inactive sound PDFs uses a non-Gaussian model.

14. The method for detecting sound activity for the signal as recited in claim 13, wherein the probability-based classifying step uses the active and inactive speech PDFs.

15. The method for detecting sound activity for the signal as recited in claim 13, wherein the adapting step comprises a step of increasing a likelihood.

16. A computer-readable medium having computer-executable instructions for performing the computer-implementable method for detecting sound activity for the signal of claim 13.

17. A method for detecting speech activity for a signal, the method comprising the steps of:

extracting a plurality of features from a digitized signal, wherein:

the plurality of features do not map one to one with the digitized signal, and the digitized signal is a digital representation of the signal;

modeling an active speech probability density function (PDF) of the plurality of features;

modeling an inactive speech PDF of the plurality of features, wherein at least one of the active or inactive speech PDFs uses a non-Gaussian model;

adapting the active and inactive speech PDFs to respond to changes in the digitized signal over time;

probability-based classifying of the digitized signal based, at least in part, the active and inactive speech PDFs; and distinguishing speech in the digitized signal based, at least in part, upon the probability-based classifying step.

18. The method for detecting speech activity for the signal as recited in claim 17, wherein both the active and inactive speech PDFs use a non-Gaussian model.

19. A computer-readable medium having computer-executable instructions for performing the computer-implementable method for detecting speech activity for the signal of claim 17.

* * * * *